US005601765A

United States Patent [19]

Sellars et al.

[11] Patent Number: 5,601,765

[45] Date of Patent: *Feb. 11, 1997

[54] METHOD FOR MANUFACTURING CRIMPED SOLVENT-SPUN CELLULOSE FIBRE OF CONTROLLED QUALITY

[75] Inventors: Alan Sellars, South Humberside; Ronald D. Payne, Humberside; Penny E. Letts, South Humberside; Neville P. Bluckert, Lincs, all of England

[73] Assignee: Courtaulds Fibres (Holdings) Limited, London, England

[ * ] Notice: The term of this patent shall not extend beyond the expiration date of Pat. No. 5,591,388.

[21] Appl. No.: 409,636

[22] Filed: Mar. 22, 1995

Related U.S. Application Data

[63] Continuation of Ser. No. 66,778, May 24, 1993, abandoned.

[51] Int. Cl.[6] ..... D01D 13/02; D02G 1/12

[52] U.S. Cl. ..... 264/40.1; 28/267; 250/559.12; 250/559.41; 356/430; 264/143; 264/151; 264/168; 264/203; 425/169; 425/296

[58] Field of Search ..... 264/142, 168, 264/203, 204, 207, 208, 187, 188, 193, 197, 198, 143, 40.1, 151, 178 F; 425/154, 169, 172, 296; 106/163.1, 168; 28/267; 250/561, 562, 571, 572, 559.12, 559.41; 356/352, 386, 430, 431; 355/482

[56] References Cited

U.S. PATENT DOCUMENTS

| | | | |
|---|---|---|---|
| 2,346,258 | 4/1944 | Hooper | 264/143 |
| 2,968,857 | 1/1961 | Swerdloff et al. | 264/168 |
| 3,044,345 | 7/1962 | Schöttler | 356/430 |
| 3,128,147 | 4/1964 | Kenyon et al. | 264/198 |
| 3,174,046 | 3/1965 | Lindemann et al. . | |
| 3,447,213 | 6/1969 | Sieme Dost et al. . | |
| 3,618,168 | 11/1971 | Mukai et al. | 425/169 |
| 3,767,360 | 10/1973 | Singh | 264/203 |
| 3,911,539 | 10/1975 | Hughes et al. | 28/267 |
| 4,145,391 | 3/1979 | Rodier | 106/163.1 |
| 4,367,191 | 1/1983 | Cuculo et al. | 264/207 |
| 4,416,698 | 11/1983 | McCorsley, III | 106/163.1 |
| 4,634,280 | 1/1987 | Paulson, Jr. | 250/571 |
| 4,692,799 | 9/1987 | Saitoh et al. | 250/562 |
| 4,739,176 | 4/1988 | Allen et al. | 250/572 |
| 5,130,559 | 7/1992 | Leifeld et al. | 250/572 |

OTHER PUBLICATIONS

"Warping Yarn Inspector," of Meiners–del Control, published in Mar. 1988.

"Technical Manual" of Meiners–Del, pp. 11–12.

"Dethroning King Cotton" by Daniel Green, published in Financial Times, Jan. 5, 1993.

*Primary Examiner*—Jay H. Woo

*Assistant Examiner*—Joseph Leyson

*Attorney, Agent, or Firm*—Fish & Richardson P.C.

[57] ABSTRACT

Crimped fibres of solvent-spun cellulose are made and checked for damage in a method in which:

i) cellulose is dissolved in an amine oxide solvent to form a hot cellulose solution, ii) the hot cellulose solution is extruded through a die assembly to form a tow of continuous filaments, iii) the tow is passed through a water bath to leach out the amine oxide iv) the tow is crimped by passing through a stuffer box in which it is compressed to apply crimp, v) dry steam being injected into the stuffer box during the crimping process, and vi) the crimped tow leaving the stuffer box is passed through detection means in which vii) a beam is projected across the path of travel of the tow and is received by receiving means on the opposite side of the tow, the receiving means being calibrated to initiate a signal if obscurement of the beam by the tow varies beyond a predetermined amount.

5 Claims, 3 Drawing Sheets

METHOD FOR MANUFACTURING CRIMPED SOLVENT-SPUN CELLULOSE FIBRE OF CONTROLLED QUALITY

This is a continuation of application Ser. No. 08/066,778 filed on May 24, 1993, now abandoned.

BACKGROUND OF THE INVENTION

1. Field of the Invention

This invention relates to the manufacture of cellulose fibre by a method comprising the spinning of continuous cellulose filaments from a solution of cellulose in an organic solvent, particularly an amine oxide solvent. Cellulose manufactured in this manner is known as lyocell and will hereafter be referred to as solvent-spun cellulose or lyocell. The invention particularly aims to provide a detection means to enable the presence of damage or any other undesirable matter on the formed continuous filaments after they have been crimped and before they are passed to a cutter to be cut to desired staple fibre length to be detected.

The manufacture of lyocell cellulose filaments is described, for example, in U.S. Pat. No. 4,416,698 the contents of which are incorporated herein by reference. This patent discloses a method of producing cellulose filaments by dissolving the cellulose in a suitable solvent such as a tertiary amine N-oxide.

A hot solution of the cellulose is extruded or spun through a suitable die assembly including a jet to produce filamentary material which is passed into water to leach out the amine oxide solvent from the extruded filaments.

2. Description of the Related Art

The production of artificially formed filaments of material by extruding or spinning a solution or liquid through a spinnerette to form the filaments is, of course, well known. Initially, relatively small numbers of individual filaments were prepared, which filaments were individually wound up for use as continuous filament material. This meant that the number of continuous filaments which needed to be produced was essentially dictated by the number of filaments which could be individually wound either before or after drying.

However, if fibre is produced as a tow or if fibre is produced as a staple fibre then different criteria apply to the number of filaments which can be produced at any one time. A tow essentially comprises a bundle of essentially parallel filaments which are not handled individually. Staple fibre essentially comprises a mass of short lengths of fibre. Staple fibre can be produced by the cutting of dry tow or it can be produced by forming a tow, cutting it while still wet, and drying the cut mass of staple fibre.

Because there is no need to handle individual filaments in the case of a tow product or a staple product, large numbers of filaments can be produced simultaneously.

Natural cellulose fibres have a natural crimp, which is advantageous in providing frictional properties when the fibres are put to use, e.g. directly for non-woven products or for the production of yarns for woven or knitted products. Lyocell, however, does not have an inherently natural crimp and it is desirable, therefore, to apply a crimp to the fibres. This may be done as described in U.S. patent application Ser. No. 08/066,543, now abandoned, entitled "Manufacture of Crimped Solvent-Spun Cellulose Fibre", the contents of which are also incorporated herein by reference. In that application is described a method and apparatus in which a continuous tow of solvent-spun cellulose filaments is formed and is passed to a crimping means comprising a nip leading into a stuffer box in which the filaments are crimped and in which the stuffer box is injected with dry steam during the crimping process. The so-crimped fibres can then be passed to a cutter to be cut to desired staple fibre length.

The present invention aims to provide a means of quality control and of alerting to damage to the crimped filamentary tow after it leaves the stuffer box and before it is passed to the cutter or to storage.

SUMMARY OF THE INVENTION

Accordingly, in one aspect the invention provides a method of forming fibres of solvent-spun cellulose in which:

i) cellulose is dissolved in an amine oxide solvent to form a hot cellulose solution, ii) the hot cellulose solution is extruded through a die assembly to form a tow of continuous filaments, iii) the tow is passed through a water bath to leach out the amine oxide iv) the tow is crimped by passing through a stuffer box in which it is compressed to apply crimp, v) dry steam being injected into the stuffer box during the crimping process, and vi) the crimped tow leaving the stuffer box is passed through detection means in which vii) a beam is projected across the path of travel of the tow and is received by receiving means on the opposite side of the tow, the receiving means being calibrated to initiate a signal if obscurement of the beam by the tow varies beyond a predetermined amount.

In another aspect the invention provides an apparatus for the detection of damage on a tow of continuous filaments of solvent-spun cellulose, which comprises means to mix cellulose and a solvent to form a hot cellulose solution, means to form a tow of continuous filaments from the hot solution, a bath through which the tow can be passed to leach the solvent from the filaments, means to crimp the filaments of the tow, means to inject dry steam into the crimping means and detection means positioned to receive the crimped tow and comprising means to project a beam across the path of the tow and receiving means on the opposite side of the tow to the means to project the beam, the receiving means being calibrated to initiate a signal if obscurement of the beam by the tow varies beyond a predetermined amount.

The tow will normally be passed through a drying stage e.g. a hot air oven, prior to the crimping stage and it may be passed from the detection means to a cutter to be cut to desired staple fibre length. Alternatively, it may be found more convenient to store the crimped tow after it has passed through the detection means and then, if desired, cut it to any required length at a later stage. Thus the cutting when carried out may be "on-line" or "off-line" with respect to the crimping stage.

The invention is equally applicable to the crimping of tows of lyocell that have been previously manufactured. Thus a tow from a storage spool may be fed to the crimping means and then through the detection means and then, if desired, to the cutting means.

In the manufacture of the solvent-spun cellulose, the amine oxide solvent used is preferably a tertiary amine N-oxide. The source of cellulose may be, for example, shredded paper or shredded wood pulp.

The detection means preferably comprises a source of collimated infra-red light or a laser beam, which is projected across the path of travel of the tow after it has been crimped and is received by a photo-receiver, e.g. a silicon photo diode. The detection means is calibrated so that the desired amount of beam blockage by the tow causes no alarm signal. However, any change, e.g. increased blockage caused by damage to a portion of the tow, causes a change in the electrical output of the photo-receiver. Any change beyond a predetermined amount triggers an appropriate signal. For example, it may trigger an audible alarm.

The detection means is preferably coupled to a microprocessor which has been programmed to analyse the data fed to it by the receiver. The microprocessor can, therefore, initiate any desired alarm and can also be used to maintain overall records for quality control analysis purposes.

It will be appreciated that in a largely automated manufacturing process an audible alarm signal will be desirable in view of the unpredictable and intermittent nature of the occurrence of damage or other undesirable matter on the crimped tow.

BRIEF DESCRIPTION OF THE DRAWINGS

Specific embodiments of the invention will now be described by way of example only with reference to the accompanying drawings in which.

DESCRIPTION OF THE PREFERRED EMBODIMENTS

Figure 1:
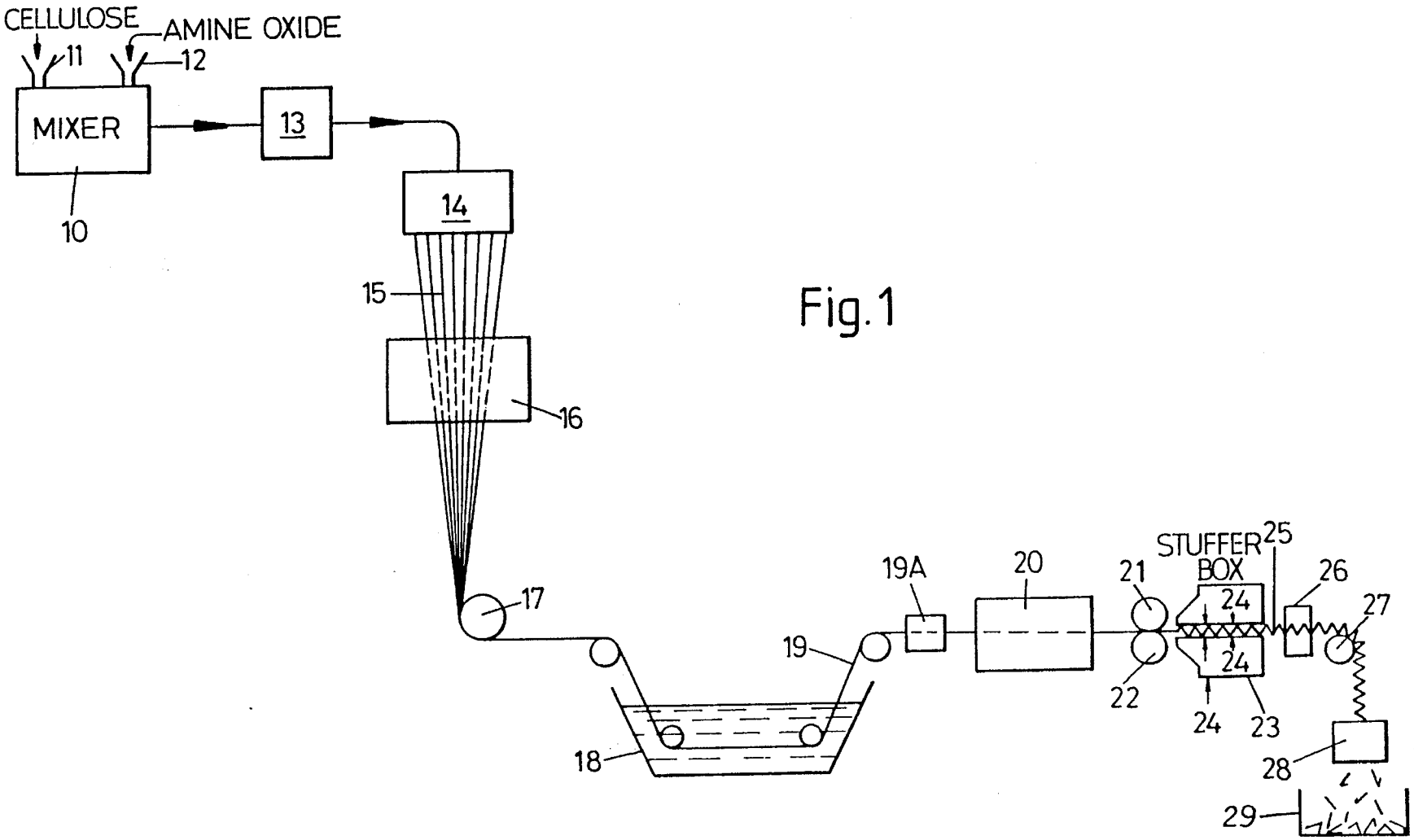
FIG. 1 is a diagrammatic representation of the various stages in the manufacture of crimped staple fibres of solvent-spun cellulose, i.e. lyocell.

In FIG. 1, shredded cellulose and an amine oxide solvent are introduced into mixer 10 via inlets 11 and 12 respectively. The hot solution is pumped via metering pump 13 to a spinnerette 14 where the solution is spun into a continuous tow 15 of fibres.

As the hot tow 15 emerges from the spinnerette 14, it is passed through a spin bath 16 in which a mixture of water and the amine oxide is recirculated. At start-up there will be no amine-oxide in the spin bath but its proportion to water may rise to about 40% by weight, e.g. 25% by weight. From spin bath 16 the tow is passed via roll 17 to a water bath 18.

The tow passing through the water bath may be, for example, up to 12 to 14 inches wide. In the water bath the amine oxide is dissolved out of the fibres and the tow 19 emerging from the water bath is of lyocell.

From water bath 18 the tow 19 is passed through a finishing stage 19A where the filaments are lubricated using spin finishes well known in the art. The tow is then passed through a drying oven 20 maintained at a temperature of about 100° to 180° C., e.g. 165° C.

The drying oven is preferably of the perforated drum type, well known in the art, but may alternatively, be of the can or calender drier type.

There may be, as shown, a single tow emerging from the spinnerette and this may contain, for example, up to 400,000 filaments and may weigh, for example, 65 ktex, i.e. 65 g/meter, after the drying stage. Alternatively, the spinnerette may produce more than one, for example, four streams of tow and these may contain over 1 million filaments each and weigh, for example, about 181 ktex each after drying.

A single tow passing through the water bath may be, as indicated above, up to 12 to 14 inches wide. However, where four tows, for example, are produced from the spinnerette, these may be combined into two tows, each pair of tows going through a separate water bath which is at least 48 inches wide and each pair of tows 24 inches wide.

The dry tow from drier 20 is then passed into a nip defined by rolls 21 and 22 from which it is fed into stuffer box 23. Dry steam is fed into the stuffer box via inlets 24. The crimped tow 25 emerging from the stuffer box has been compressed to a width of about 4 to 5 inches. It is then allowed to spread to about 12 to 18 inches width and is pulled with a force of from about 100 to 340 lbs, e.g. about 220 lbs. Thus the tension applied to the 181 kilotex tows is from about 0.55 to about 1.88 lbs./kilotex. The tow is then passed through detection means 26. After passing through the detection means it is passed via roll 27 to cutter 28 where it is cut to staple fibre length. The crimped staple fibre lengths are collected in box 29.

Figure 2:
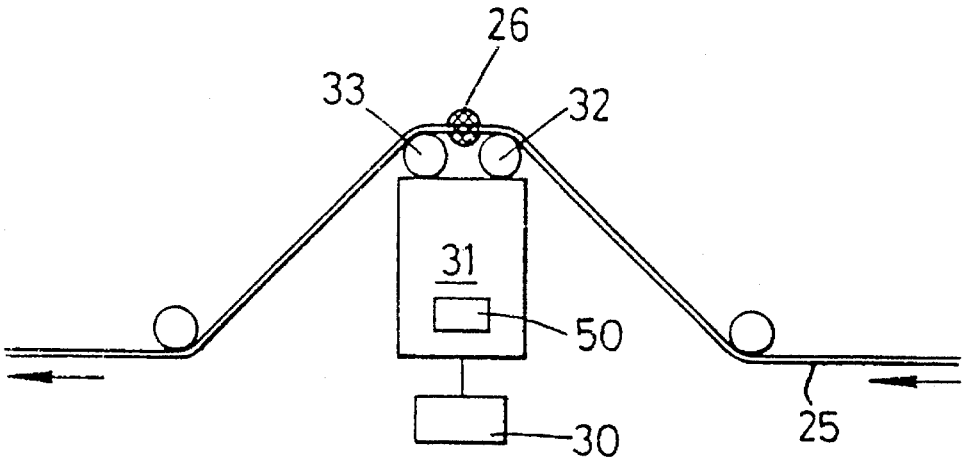
FIG. 2 is a diagrammatic side view showing the damage detection means positioned to monitor crimped tow as it passes to a cutter.
Figure 3:
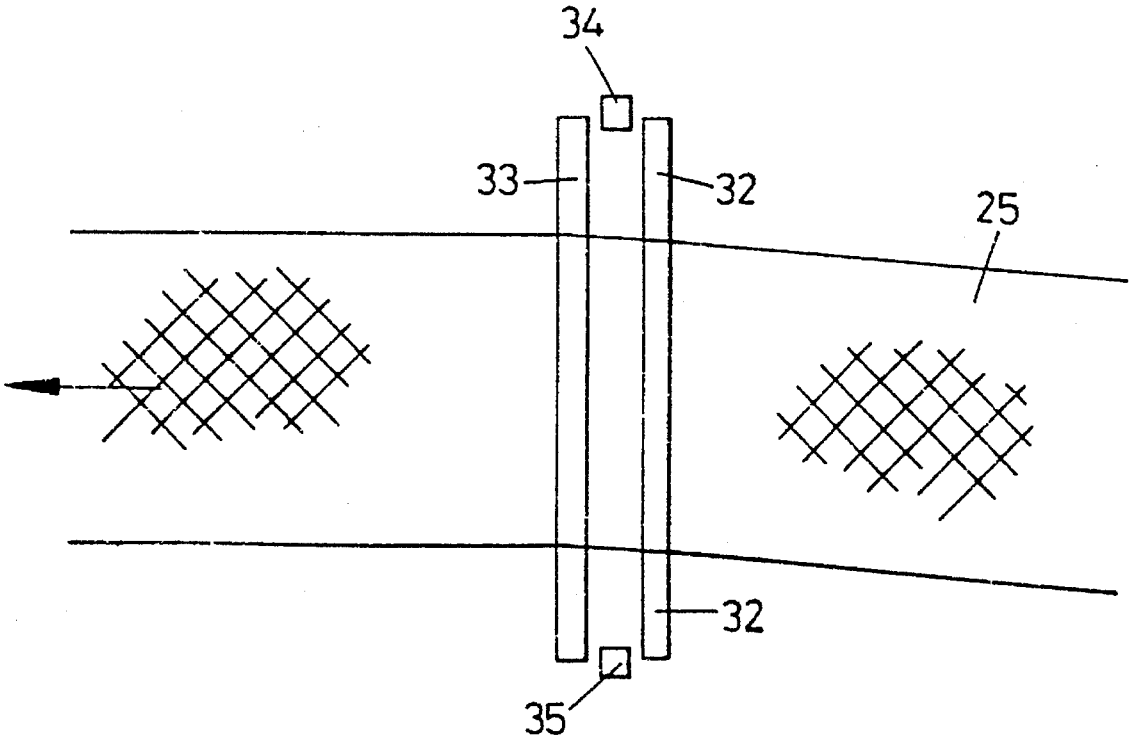
FIG. 3 is a plan view of the position shown in FIG. 2.

In FIGS. 2 and 3 is shown in greater detail the crimped tow 25 passing through the detection means 26. The detection means comprises a counter base 31 above which are set rolls 32 and 33 over which the tow passes. Between rolls 32 and 33 the tow passes in front of an infra-red light source 34 which projects an infra-red beam across the path of travel of the tow. On the other side of the tow from light source 34 is a silicon photo-diode receiver 35 which detects the infra-red beam passing across the tow. As indicated above, at this point, the tow may be from 12 to 18 inches wide so that light source 34 and receiver 35 are spaced apart by a little more than that amount.

Figure 4:
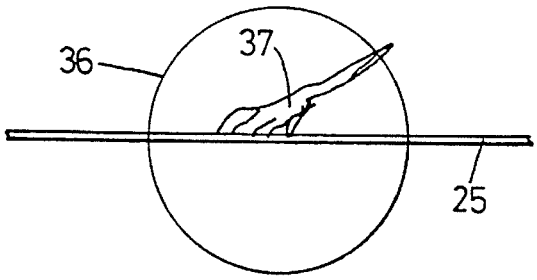
FIG. 4 is a diagrammatic side view showing the detector beam of FIG. 2 relative to the tow in a first embodiment.

As shown in FIG. 4, the beam 36 is set so that tow 25 passes centrally through it. Any damage, e.g. a loose filament, 37 obscures more of the beam from the detector. If the obscurement is above a predetermined amount an alarm 50 will be triggered.

Figure 5:
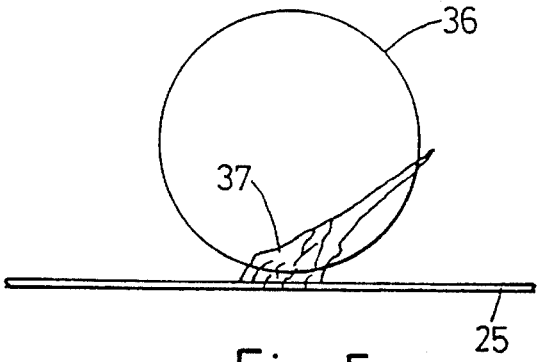
FIG. 5 is a diagrammatic side view showing the detector beam of FIG. 2 relative to the tow in a second embodiment.

In an alternative embodiment, as shown in FIG. 5, the beam 36 is set up so that the tow 25 passes just below it. The undamaged tow, therefore, does not obscure the beam at all whereas a piece of loose filament or other damage 37 protruding above the tow does obscure the beam as the tow passes through the detection means. The gap between the lowermost portion of the beam and the top of the undamaged tow may be adjusted according to the minimum upstanding size of damage that it is desired to detect. For example, the gap between the beam and the tow may be from ⅛ to ¾ inch, e.g. ⅝ inch.

Figure 6:
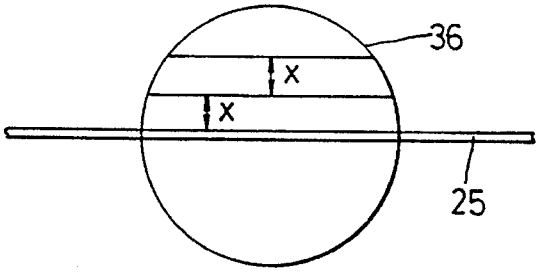
FIG. 6 is a similar side view to FIG. 4, showing the tow passing centrally through the detector beam.
Figure 7:
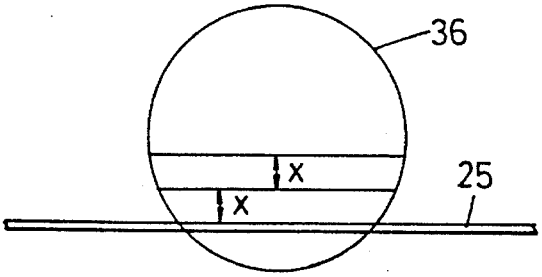
FIG. 7 is a similar view to FIG. 6 but showing the tow passing through a lower portion of the beam.

FIGS. 6 and 7 illustrate one means of changing the sensitivity of the detection means.

In FIG. 6, in which the tow passes through the centre of the beam, an obstruction of height 2x is seen to produce less than double the obscurement of the beam caused by an obstruction of height x. In FIG. 7, in which the tow passes through the lower half of the beam, an obstruction of height 2x gives obscurement of the beam of more than double that caused by an obstruction of height x. Thus it can be appreciated that the position of the beam relative to the tow can be adjusted according to the size of damage preferably wished to be detected.

The system in all embodiments can be calibrated so that a predetermined level of obscurement of the beam will increment a counter in counter base 31 and sound an alarm 50. Counter base 31 may contain or be connected to a microprocessor 30 which may control the alarm and analyse the counter data.

The detection means may also be calibrated to allow for gradual changes in tow thickness whereby it slowly automatically compensates for changes in the amounts of light received by the receiver. Thus, if for example, 50% of the beam becomes obscured for any length of time, the remaining 50% becomes the "normal" level and the sensitivity is, therefore, doubled. In other words, the detection means counts sudden changes in the level of light received, while at the same time slowly adjusting the notional normal or "zero" obscurement level.

It will be appreciated that various embodiments may be changed from those described above without departing from the scope and spirit of the invention.

We claim:

1. A method for the production of staple cellulose fibre which comprises dissolving cellulose in an amine oxide solvent to form a hot cellulose solution, extruding the hot solution through a die assembly to form a multi-filamentary tow of continuous filaments, passing the tow of continuous filaments through a water bath to leach out the amine oxide, crimping the leached tow in a stuffer box while simultaneously injecting dry steam into the stuffer box, withdrawing the crimped tow from the stuffer box and moving it along a predetermined path while applying tension to the tow in the range of 0.55 pounds/kilotex to 1.88 pounds/kilotex, projecting a light beam across the crimped tow as it is moved along said path under tension in said range, measuring the degree by which the beam is obscured by the tow and generating a signal when the beam is obscured by more than a predetermined amount, and then passing the tow downstream of the beam to a cutter and cutting the tow with the cutter to form a staple fibre.

2. The method claimed in claim 1 wherein the tow is dried after being passed through the water bath and before being crimped.

3. The method claimed in claim 1 wherein the signal is an audible signal.

4. The method claimed in claim 1 in which the degree by which the beam is obscured by the tow is monitored by a microprocessor.

5. A method according to claim 1, in which the amine oxide solvent is a tertiary amine N-oxide.

* * * * *